US011400576B1

(12) United States Patent
Myers

(10) Patent No.: US 11,400,576 B1
(45) Date of Patent: Aug. 2, 2022

(54) EARTH BREAKING IMPLEMENT ATTACHMENT

(71) Applicant: Dylan Myers, Okmulgee, OK (US)

(72) Inventor: Dylan Myers, Okmulgee, OK (US)

( * ) Notice: Subject to any disclaimer, the term of this patent is extended or adjusted under 35 U.S.C. 154(b) by 29 days.

(21) Appl. No.: 16/998,248

(22) Filed: Aug. 20, 2020

(51) Int. Cl.
*B25D 17/02* (2006.01)
*B25D 9/12* (2006.01)
*E21B 11/00* (2006.01)

(52) U.S. Cl.
CPC ..... *B25D 9/12* (2013.01); *B25D 17/02* (2013.01); *E21B 11/005* (2013.01)

(58) Field of Classification Search
None
See application file for complete search history.

(56) References Cited

U.S. PATENT DOCUMENTS 165,890 A * 7/1875 Taylor ..... E21B 11/005 175/316
293,490 A * 2/1884 Miles ..... E21B 11/005 175/384
318,653 A * 5/1885 Porter ..... E21B 11/005 175/316
633,574 A * 9/1899 Densmore ..... E21B 11/005 175/170
677,403 A * 7/1901 Driskill ..... E21B 11/005 175/384
779,968 A * 1/1905 Robertson ..... E21B 11/005 175/316
2,533,555 A * 12/1950 Canales ..... E21B 11/005 175/320
3,402,969 A * 9/1968 Hoen ..... B25D 17/02 279/87
3,444,938 A * 5/1969 Ballmann ..... E21B 11/005 175/173
3,986,570 A 10/1976 Stinson et al.
5,095,600 A 3/1992 Allan
5,878,823 A 3/1999 Henriksson
6,129,163 A 10/2000 Hamilton et al.
7,111,691 B2 9/2006 Siltanen et al.
8,021,079 B1 9/2011 Rackham
8,944,187 B1 * 2/2015 Cordova ..... E21B 11/005 175/213
2017/0042079 A1 * 2/2017 Harris ..... E21B 11/005
2018/0179845 A1 * 6/2018 Pallin ..... E21B 31/107
2019/0338491 A1 * 11/2019 Walker ..... E02F 9/2883

OTHER PUBLICATIONS

RH1826EX. Product Listing [online] Rhino® Equipment [retrieved on Feb. 27, 2020]. Retrieved from the Internet: <URL: https://rhinoeq.com/hammers/1826ex/>.

* cited by examiner

*Primary Examiner* — Nathaniel C Chukwurah
*Assistant Examiner* — Tanzim Imam
(74) *Attorney, Agent, or Firm* — Cramer Patent & Design, PLLC; Aaron R. Cramer

(57) ABSTRACT

An earth breaking implement attachment includes a hydraulic pole ram capable of having a plurality of attachments secured to a foot. The attachment is presented in either a first embodiment or a second embodiment. The first attachment is shaped like a shark tooth. The second embodiment has a similar appearance of a screwdriver head.

10 Claims, 5 Drawing Sheets

EARTH BREAKING IMPLEMENT ATTACHMENT

FIELD OF THE INVENTION

The presently disclosed subject matter is directed to an attachment for an earth breaking implement.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. Each field of work has its own type of specialty tools, each performing a specialized task. One task common to many lines of work is that of rock or obstruction removal, such as may be encountered in demolition, construction, building fences, erecting power poles, and the like.

Many times, equipment such as excavators or hole augers cannot break through the rock, but the power of a jackhammer is not needed. Also, a jack hammer may not be available or too costly for the removal of just one rock or piece of concrete. Accordingly, there exists a need for means by which obstructions such as rock, unwanted concrete and the like can be easily removed without the use of a jackhammer. The development of the earth breaking implement attachment fulfills this need.

SUMMARY OF THE INVENTION

The principles of the present invention provide for a rock breaking attachment which comprises a main body, a cutting edge which is disposed on a first end of the main body, a plurality of reinforcements which provide structural strength and rigidity to the main body and a polymer bushing which is disposed on a second end of the main body. The polymer bushing provides a contact surface for attachment to a tamping foot of a hydraulic tamp and a pair of clamp fasteners which mechanically couple the rock breaking attachment to the tamping foot of the hydraulic tamp. The main body and the cutting edge are reminiscent of a shark's tooth.

The pair of clamp fasteners may mechanically couple the rock breaking attachment to the hydraulic tamp via friction fit. The main body and the cutting edge may be mechanically coupled against the polymer bushing and the tamping foot and secured with the pair of clamp fasteners. The clamp fasteners may have a main clamp body which may extend over the top of the tamping foot and may be secured on the distal side of the polymer bushing with the securing brace via an auxiliary brace. A finger snap clamp may lock the auxiliary brace to the securing brace using a snap hinge having spring pressure. A main clamp body may be provided with a securing brace which may be connected through a pivot fastener on the top of the main body and a fixed block on the bottom of the main body.

The tamping foot may be provided with a downward facing curved shape reminiscent of a kidney bean. The cutting edge and its symmetrical arrangement with the main body and the reinforcements may be reminiscent of the shark's tooth. The main body, the cutting edge, and the reinforcements may be made of high-grade silicon or boron steel. The rock breaking attachment may be for the hydraulic tamp to assist in breaking one or more obstructions selected from the group consisting of one or more rocks, one or more bedrocks, or one or more concrete objects.

A separate embodiment of a rock breaking attachment comprises a main body, a cutting edge which is disposed on a first end of the main body, a plurality of reinforcements which provides structural strength and rigidity to the main body and a polymer bushing which is disposed on a second end of the main body. The polymer bushing provides a contact surface for attachment to a tamping foot of a hydraulic tamp. The rock breaking attachment also comprises a pair of clamp fasteners which mechanically couple the rock breaking attachment to the tamping foot of the hydraulic tamp. The main body and the cutting edge are reminiscent of a Philips screwdriver.

The pair of clamp fasteners for the alternate embodiment may mechanically couple the rock breaking attachment to the hydraulic tamp via friction fit. The main body and the cutting edge may be mechanically coupled against the polymer bushing and the tamping foot and secured with the pair of clamp fasteners. The clamp fasteners may have a main clamp body which extends over the top of the tamping foot and may be secured on the distal side of the polymer bushing with the securing brace via an auxiliary brace. A finger snap clamp may lock the auxiliary brace to the securing brace using a snap hinge having spring pressure. A main clamp body may be provided with a securing brace connected through a pivot fastener on the top of the main body and a fixed block on the bottom of the main body. The tamping foot may be provided with a downward facing curved shape reminiscent of a kidney bean.

The cutting edge and its symmetrical arrangement with the main body and the reinforcements may be reminiscent of the Philips screwdriver. The main body, the cutting edge, and the reinforcements may be made of high-grade silicon or boron steel. The rock breaking attachment may be for the hydraulic tamp to assist in breaking one or more obstructions selected from the group consisting of one or more rocks, one or more bedrocks, or one or more concrete objects.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
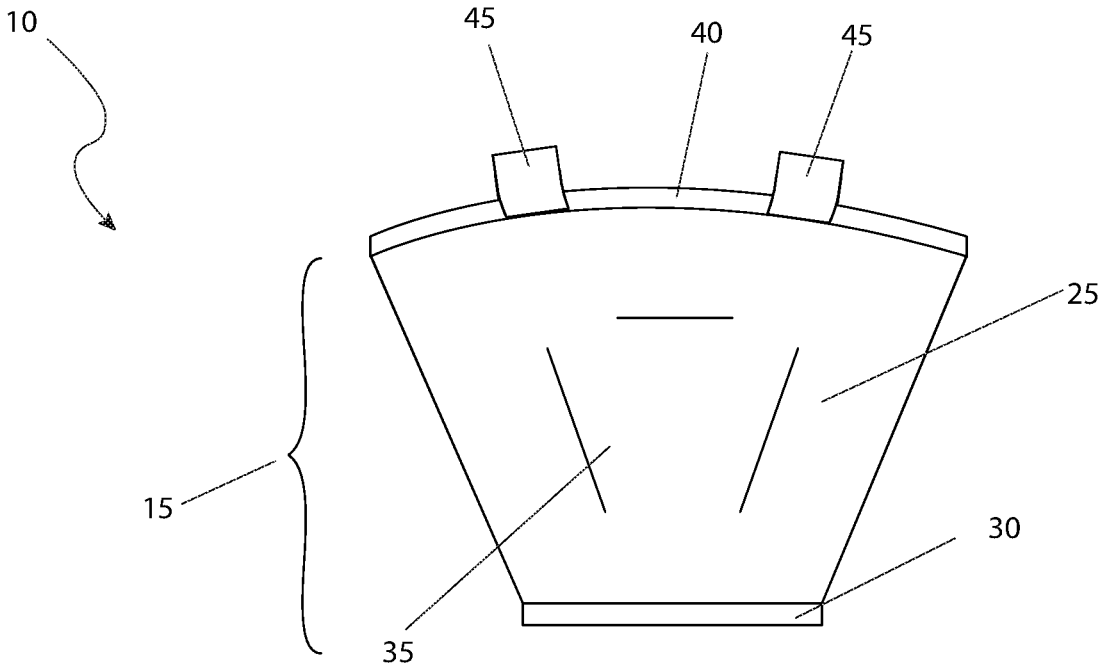
FIG. 1 is a side view of the rock breaking attachment, according to the first embodiment of the present invention.

10 rock breaking attachment
15 first embodiment

20 second embodiment
25 first main body
30 first cutting edge
35 first reinforcement
40 polymer bushing
45 clamp fastener
50 second main body
55 second cutting edge
60 second reinforcement
65 hydraulic tamp
70 tamping foot
75 reciprocating mechanism
80 shaft handle
85 connection hose
90 main clamp body
95 first securing brace
100 first auxiliary brace
105 finger snap clamp
108 snap hinge
110 second securing brace
115 pivot fastener
118 fixed block
120 user
125 obstruction
130 grade

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side view of the rock breaking attachment 10, according to the preferred embodiment of the present invention is disclosed. The rock breaking attachment 10 (herein also described as the "attachment") 10, provides an attachment 10 for a hydraulic tamp 65 to assist in the breaking of obstructions 125, such as rock and other obstacles. The attachment 10 is provided in a desired embodiment (herein referred to as a first embodiment 15 and a second embodiment 20) perform fracturing and breaking of obstructions 125 such as rock, bedrock, concrete and other obstacles not normally penetrated by backhoes, shovels, picks and the like, but also where the use of a larger jack hammer is not feasible, warranted, or cost-effective The first embodiment 15 provides for a first main body 25 and a first cutting edge 30 that are in the overall shape reminiscent of a shark's tooth. Various first reinforcements 35 provide for structural strength and rigidity during use. A polymer bushing 40 provides a contact surface for attachment to the tamping foot 70 of the hydraulic tamp 65 as will be shown below. Two (2) clamp fasteners 45 allow for securement of the first embodiment 15. Further description of the operation of the clamp fasteners 45 will be shown herein below. It is envisioned that the first main body 25, the first cutting edge 30, and the first reinforcements 35 would be made of a high-grade silicon and/or boron steel.

Figure 2:
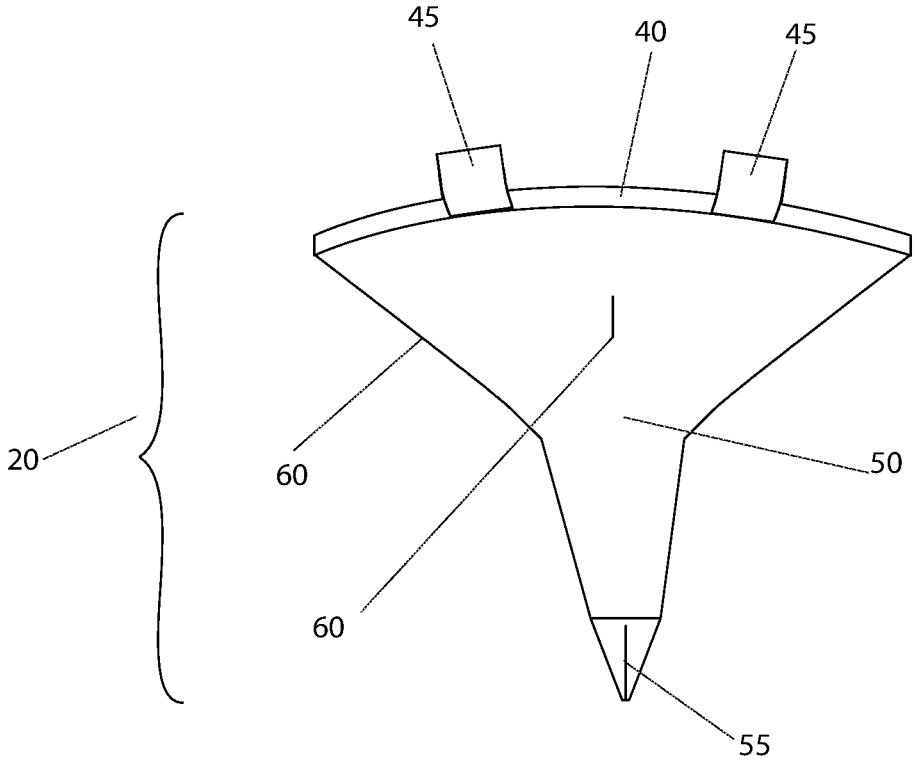
FIG. 2 is a side view of the rock breaking attachment, according to the second embodiment of the present invention.

Referring next to FIG. 2, a side view of the attachment 10, according to the preferred embodiment of the present invention is depicted. The second embodiment 20 provides for a second main body 50 and a second cutting edge 55 that are in the overall shape reminiscent of a Philips screwdriver bit. Various second reinforcements 60 provide for structural strength and rigidity during use. As before, the polymer bushing 40 provides a contact surface for attachment to the tamping foot 70 of the hydraulic tamp 65 as will be shown below. The two (2) clamp fasteners 45 allow for securement of the second embodiment 20. Further description of the operation of the clamp fasteners 45 will be shown herein below. It is envisioned that the second main body 50, the second cutting edge 55, and the second reinforcements 60 would be made of a high-grade silicon and/or boron steel.

Figure 3:
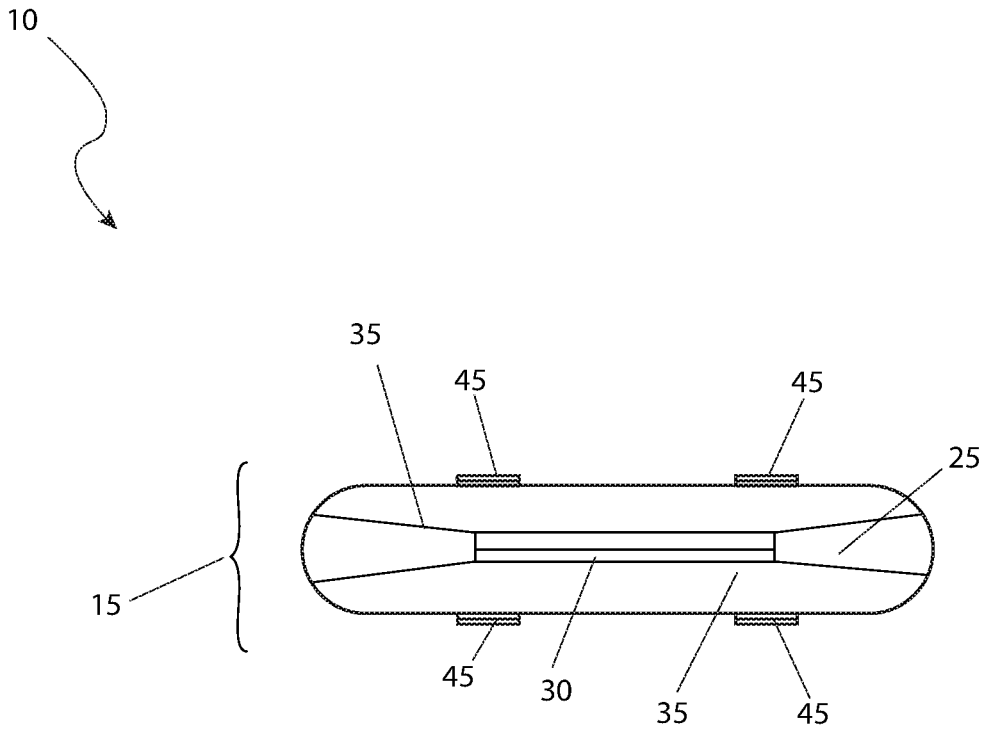
FIG. 3 is an end view of the rock breaking attachment, according to the first embodiment of the present invention.

Referring now to FIG. 3, an end view of the attachment 10, according to the first embodiment 15 of the present invention is shown. This view provides clarification on the first embodiment 15, the first cutting edge 30 and its symmetrical arrangement with the first main body 25 and the first reinforcements 35, providing the general appearance of a shark's tooth. The outer portion of the clamp fasteners 45 remain visible.

Figure 4:
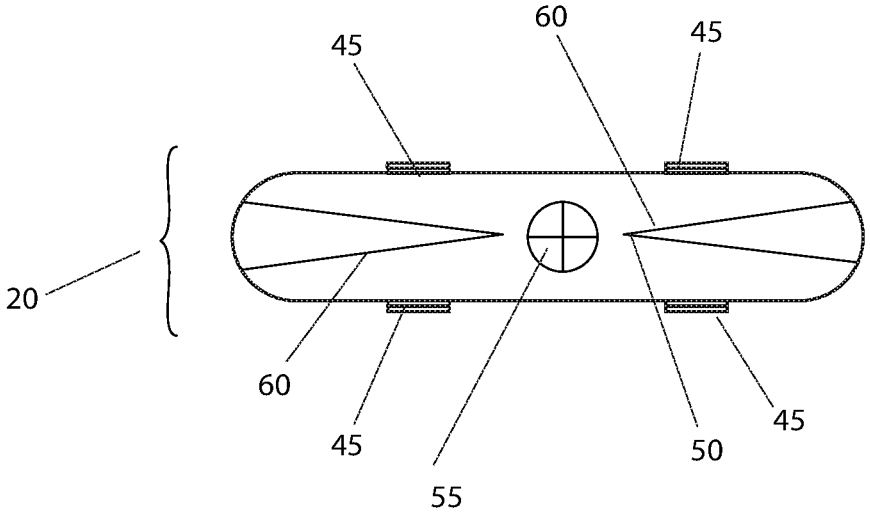
FIG. 4 is an end view of the rock breaking attachment, according to the second embodiment of the present invention.

Referring next to FIG. 4, an end view of the attachment 10, according to the preferred embodiment of the present invention is disclosed. This view provides clarification on the second embodiment 20, the second cutting edge 55 and its symmetrical arrangement with the second main body 50 and the second reinforcements 60, providing the general appearance of a Philips screwdriver when viewed from the end. The outer portion of the clamp fasteners 45 remain visible.

Figure 5:
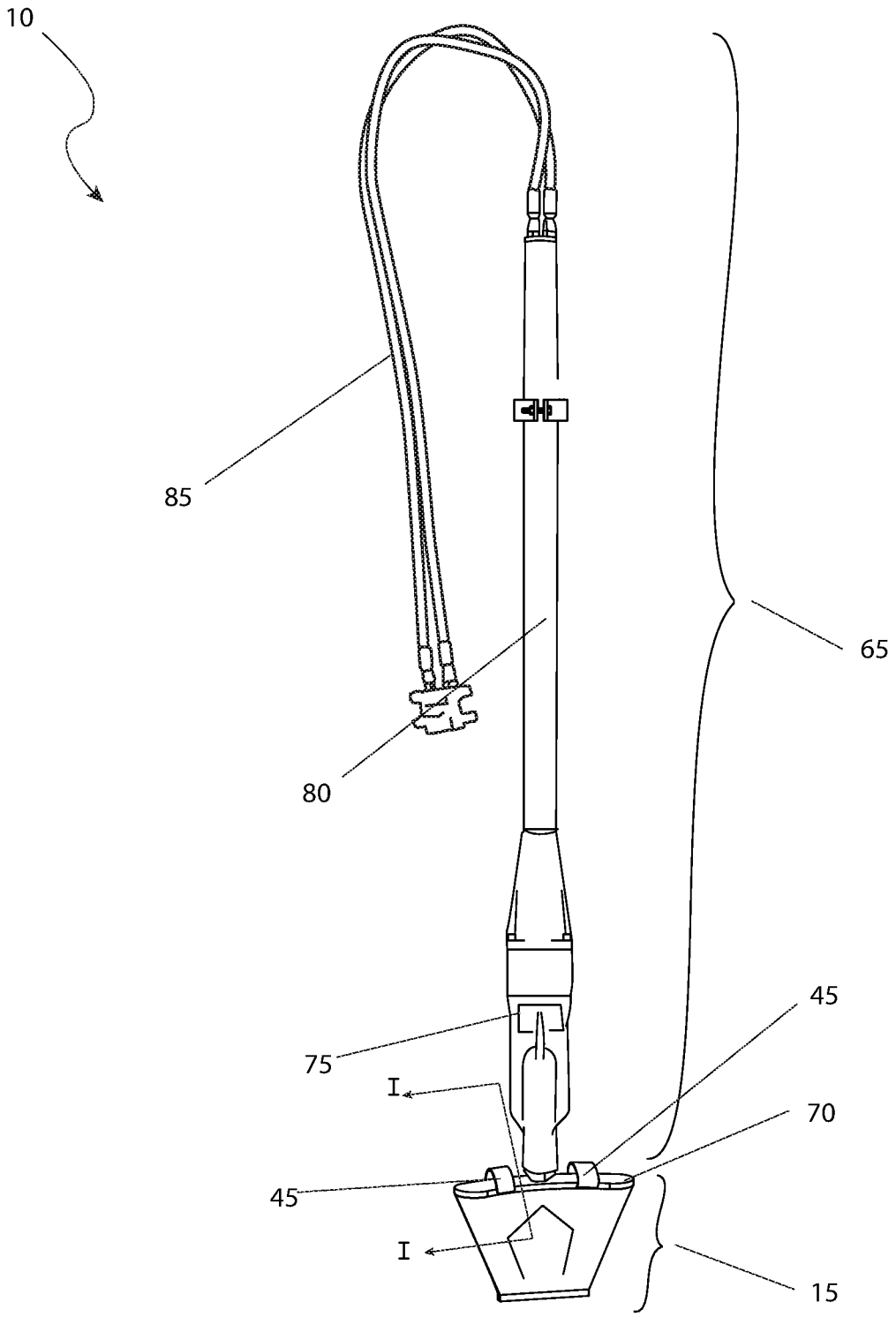
FIG. 5 is a perspective view of the rock breaking attachment installed on a hydraulic tamp according to the first and second embodiment of the present invention.

Referring now to FIG. 5, a perspective view of the attachment 10 installed on a hydraulic tamp 65 according to the first embodiment of the present invention is depicted. The hydraulic tamp 65 is typical in nature and provides for a tamping foot 70, a reciprocating mechanism 75, a shaft handle 80 and connection hoses 85. The tamping foot 70 is provided with a downward facing curved shape, reminiscent to the shape of a kidney bean. The first embodiment 15 is mechanically coupled to friction fit by the two (2) clamp fasteners 45. It is noted that the attachment method for the second embodiment 20 (as shown in FIG. 2 and FIG. 4) is identical in nature to that shown here.

Figure 6:
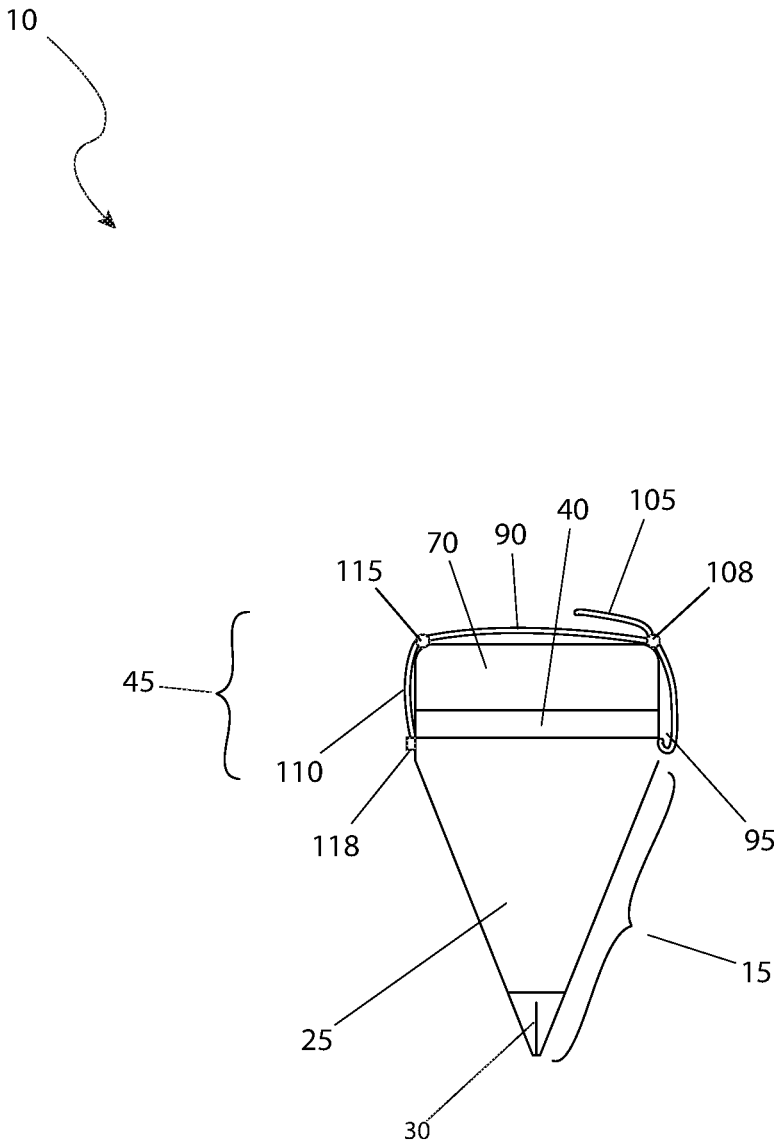
FIG. 6 is a side view of the rock breaking attachment, as seen along a line I-I, as shown in FIG. 5; according to the first embodiment of the present invention; and, FIG. 7 is a perspective view of the rock breaking attachment, shown in a utilized state, according to the second embodiment of the present invention.

Referring next to FIG. 6, a side view of the attachment 10, as seen along a line I-I, as shown in FIG. 5; according to the first embodiment 15 of the present invention is shown. The first embodiment 15, including the first main body 25 and the first cutting edge 30 is coupled against the polymer bushing 40 and the tamping foot 70 and secured with the two (2) clamp fasteners 45 (of which only one (1) is shown due to illustrative limitations. The clamp fasteners 45 have a main clamp body 90 which extends over the top of the tamping foot 70 and is secured on the distal side of the polymer bushing 40 with a first securing brace 95 via an auxiliary brace 100. A finger snap clamp 105 locks the auxiliary brace 100 to the first securing brace 100 using a snap hinge 108 with spring pressure. The opposite side of the of the main clamp body 90 is provided with a second securing brace 110 connected through a pivot fastener 115 on the top and a fixed block 118 on the bottom. This arrangement allows for firm and locking securement of the first embodiment 15 or the second embodiment 20 (as shown in FIG. 2 and FIG. 4) without the use of tools in a quick and secure manner. With the first embodiment 15 and the second embodiment 20 removed, the tamping foot 70 can be quickly returned to use as a conventional tamp with no permanent modifications.

Figure 7:
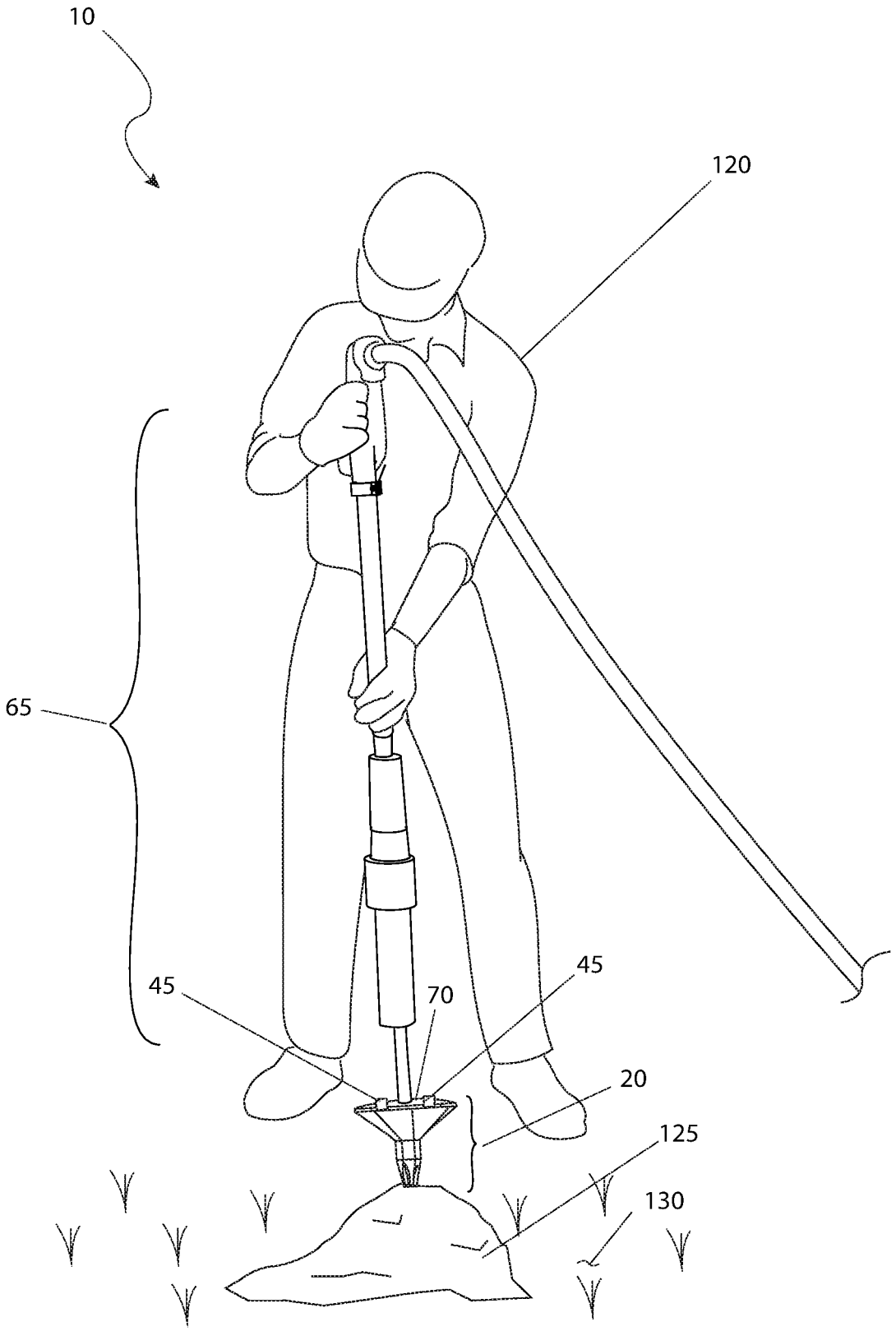

Referring to FIG. 7, a perspective view of the attachment 10, shown in a utilized state, according to the second embodiment 20 of the present invention is disclosed. A user 120 operates a hydraulic tamp 65 with the second embodiment 20 attached to the tamping foot 70 via the clamp fasteners 45. The second embodiment 20 is placed against an obstruction 125 such as a rock, boulder, or the like in the way of an excavation, drilled hole, trench or the like in the grade 130. After several blows from the above described process, the obstruction 125 will be shattered into smaller pieces that can be more easily moved by shovels, excavators, powered equipment, drilling rigs, or the like.

2. Operation of the Preferred Embodiment

The preferred embodiment of the present invention can be utilized by the common user in a simple and effortless manner with little or no training. It is envisioned that the attachment 10 would be constructed in general accordance with FIG. 1 through FIG. 5. The user 120 would procure either embodiment 15, 20 of the attachment 10 from conventional procurement channels such as industrial supply houses, construction equipment suppliers, mechanical supply houses, mail order and internet supply houses and the like.

After procurement and prior to utilization, either the first embodiment 15 or the second embodiment 20 would be chosen based upon the specific need; the second embodiment 20 would provide for a more concentrated impact for use in breaking larger and more resilient obstructions 125; the first embodiment 15 would provide for shaping and removing obstructions 125 such as bedrock, concrete and the like, where portions of the underground obstruction 125 would remain behind and openings or channels would be made; the polymer bushing 40 would be placed against the tamping foot 70; the main clamp body 90 would be hooked over the first securing brace 95; and the finger snap clamp 105 would be pushed downward for both clamp fasteners 45. At this point in time, the attachment 10 is ready for use.

During utilization of the attachment 10, the following procedure would be initiated: the first cutting edge 30 of the first embodiment 15 or the second cutting edge 55 of the second embodiment 20 would be placed against the obstruction 125; the hydraulic tamp 65 would be operated for a period of time until the obstruction 125 is broken or cleared.

After use of the attachment 10, the first embodiment 15 or the second embodiment 20 can be removed by disconnecting the two (2) clamp fasteners 45 by reversing the above described process to allow use of the hydraulic tamp 65 in a conventional manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A rock breaking attachment, comprising:

a main body;

a cutting edge disposed on a first end of the main body;

a plurality of reinforcements providing structural strength and rigidity to the main body;

a polymer bushing disposed on a second end of the main body, the polymer bushing providing a contact surface for attachment to a tamping foot of a hydraulic tamp; and a pair of clamp fasteners mechanically coupling the rock breaking attachment to the tamping foot of the hydraulic tamp;

wherein the main body and the cutting edge are reminiscent of a Philips screwdriver.

2. The rock breaking attachment, according to claim 1, wherein the pair of clamp fasteners mechanically couple the rock breaking attachment to the hydraulic tamp via friction fit.

3. The rock breaking attachment, according to claim 2, wherein the main body and the cutting edge are mechanically coupled against the polymer bushing and the tamping foot and secured with the pair of clamp fasteners.

4. The rock breaking attachment, according to claim 1, wherein the clamp fasteners have a main clamp body which extends over a top of the tamping foot and is secured on a distal side of the polymer bushing with a securing brace via an auxiliary brace.

5. The rock breaking attachment, according to claim 1, wherein a finger snap clamp locks the auxiliary brace to the securing brace using a snap hinge having spring pressure.

6. The rock breaking attachment, according to claim 1, wherein a main clamp body is provided with a securing brace connected through a pivot fastener on a top of the main body and a fixed block on a bottom of the main body.

7. The rock breaking attachment, according to claim 1, wherein the tamping foot is provided with a downward facing curved shape reminiscent of a kidney bean.

8. The rock breaking attachment, according to claim 1, wherein the cutting edge and its symmetrical arrangement with the main body and the reinforcements are reminiscent of the Philips screwdriver.

9. The rock breaking attachment, according to claim 1, wherein the main body, the cutting edge, and the reinforcements are made of high-grade silicon or boron steel.

10. The rock breaking attachment, according to claim 1, wherein the rock breaking attachment is for the hydraulic tamp to assist in breaking one or more obstructions selected from the group consisting of one or more rocks, one or more bedrocks, or one or more concrete objects.

* * * * *